US007621710B2

(12) United States Patent
Ichioka

(10) Patent No.: US 7,621,710 B2
(45) Date of Patent: Nov. 24, 2009

(54) WORK SHEET CONVEYING AND HOUSING SYSTEM AND WORK SHEET CONVEYING AND HOUSING METHOD

(75) Inventor: Hirokazu Ichioka, Inuyama (JP)

(73) Assignee: Murata machinery, Ltd., Kyoto (JP)

( * ) Notice: Subject to any disclaimer, the term of this patent is extended or adjusted under 35 U.S.C. 154(b) by 0 days.

(21) Appl. No.: 12/112,973

(22) Filed: Apr. 30, 2008

(65) Prior Publication Data

US 2008/0284094 A1 Nov. 20, 2008

(30) Foreign Application Priority Data

May 16, 2007 (JP) ..... 2007-130183

(51) Int. Cl.
*B65G 1/00* (2006.01)

(52) U.S. Cl. ..... 414/331.11; 414/331.06

(58) Field of Classification Search ..... 271/292, 271/294, 287; 414/331.06, 331.08, 331.01, 414/331.11, 331.07
See application file for complete search history.

(56) References Cited

FOREIGN PATENT DOCUMENTS

JP 2004-123276 4/2004
JP 2006-341969 12/2006
JP 2006341969 A * 12/2006

* cited by examiner

*Primary Examiner*—Patrick H Mackey
*Assistant Examiner*—Ernesto Suarez
(74) *Attorney, Agent, or Firm*—Hogan & Hartson LLP

(57) ABSTRACT

The present invention provides a work sheet conveying and housing system which can efficiently convey and house work sheets and which, in a housed condition, prevents formed parts of the work sheets from being crushed. The work sheet conveying and holding system includes a work sheet stocker 4 and a work sheet conveying device 2. The work sheet stocker 4 has trays 34 in a plurality of stages the position of which can be switched between an inner position A where the trays 34 are housed in a tray housing portion 32 in a stocker frame 30 and an outer position B where the trays 34 are drawn out of the tray housing portion 32. The work sheet conveying device has work sheet holding means 20 capable of holding a work sheet W2, and moving means having a function of moving the work sheet holding means 20 parallel to a position switching direction corresponding to a direction in which the trays are drawn out. The moving means moves the work sheet holding means 20 parallel to the position switching direction to switch the position of the uppermost one 34 of the trays 34 in the plurality of stages located at the outer position B, to the inner position A and to position the work sheet holding means 20 above a tray located one stage below the uppermost tray 34.

4 Claims, 9 Drawing Sheets

WORK SHEET CONVEYING AND HOUSING SYSTEM AND WORK SHEET CONVEYING AND HOUSING METHOD

FIELD OF THE INVENTION

The present invention relates to a work sheet conveying and housing system that conveys work sheets from a work sheet processing machine or the like and houses the work sheets, as well as a relevant work sheet conveying and housing method.

BACKGROUND OF THE INVENTION

A work sheet stocker temporarily stores product work sheets processed by a work sheet processing machine such as a punch press, or the work sheets stored in the work sheet stocker are transported to a next process. In a common work sheet stocker, product work sheets are loaded in a stack from bottom to top in the order in which the product sheets have been processed. However, where the product work sheets are loaded in a stack, it is difficult to take out lower product work sheets in the stack. This affects a setup for the subsequent step. Furthermore, where the product work sheets are formed articles, upper product work sheets in the stack are raised by the formed parts. Consequently, where a large number of work sheets are loaded, the product work sheets may disadvantageously be collapsed. Furthermore, the formed parts of the product work sheets may disadvantageously be crushed or damaged by the weight of the upper product work sheets, the misalignment of the product work sheets stacked in the vertical direction, or the like.

To deal with these problems, the Unexamined Japanese Patent Application Publication (Tokkai-Hei) No. 2006-341969 proposes a work sheet housing system including a work sheet stocker having a shelf with a plurality of stages on each of which a product work sheet is housed. This work sheet housing system enables the product work sheets to be housed in the plurality of stages of the shelf in the work sheet stocker without bringing the product work sheets into contact with one another. The product work sheet in each of the stages can thus be freely taken out. Even if the product work sheets are formed articles, a large number of product work sheets can be housed without being collapsed. The formed parts of the product work sheets are also prevented from being crushed. Furthermore, the Unexamined Japanese Patent Application Publication (Tokkai-Hei) No. 2004-123276 has made a proposal for the problem with the product work sheets that are formed articles.

Where the work sheet stocker having the shelf with the plurality of stages is used as is the case with the work sheet housing system in the Unexamined Japanese Patent Application Publication (Tokkai-Hei) No. 2006-341969, the position of the shelf in the work sheet stocker needs to be switched between a use position where the product work sheets are placed and housed on the shelf and a retract position where the shelf is retracted from the use position. In the Unexamined Japanese Patent Application Publication (Tokkai-Hei) No. 2006-341969, an unloader that houses the product work sheets in the work sheet stocker switches the position of the shelf, allowing required labor to be saved. However, the unloader separately performs an operation of housing the product work sheets in the work sheet stocker and an operation of switching the position of the shelf in the work sheet stocker. Thus, the unloader needs to perform complicated operations in order to house the product work sheet on one stage of the shelf. This is inefficient.

SUMMARY OF THE INVENTION

An object of the present invention is to provide a work sheet conveying and housing system that can efficiently convey and house work sheets such as product work sheets which are processed by a work sheet processing machine, the system allowing, in a housed condition, each of the work sheets to be freely taken out, and where the product work sheets are formed articles, allowing a large number of work sheets to be housed without being collapsed, the system also preventing the formed parts of the formed articles from being crushed or damaged. Another object of the present invention is to, where the work sheets are placed on trays in a plurality of stages, enable the work sheets to be accurately placed on the trays in the respective stages and to enable the trays with the work sheets placed thereon to be accurately housed. Yet another object of the present invention is to simplify the operation of housing the work sheets. Still another object of the present invention is to provide a work sheet conveying and housing method making it possible to efficiently convey and house work sheets such as product work sheets which are processed by a work sheet processing machine, the method allowing, in a housed condition, each of the work sheets to be freely taken out, and where the product work sheets are formed articles, allowing a large number of work sheets to be housed without collapsing the housed work sheets, the method also preventing the formed parts of the formed articles from being crushed or damaged.

A work sheet conveying and housing system according to the present invention comprises a work sheet stocker in which a plurality Of work sheets can be housed, and a work sheet conveying device that conveys a work sheet to the work sheet stocker, and the work sheet stocker has a stocker frame having a tray housing portion with a plurality of stages, and trays which are provided in the respective stages of the tray housing portion and the position of which can be freely switched between an inner position where the trays are housed in the tray housing portion and an outer position where the tray are drawn out of the tray housing portion. The work sheet conveying device has a work sheet holding means capable of holding the work sheet, and a moving means having a function of moving the work sheet holding means parallel to a position switching direction corresponding to a direction in which the trays are drawn out. The moving means moves the work sheet holding means parallel to the position switching direction to switch the position of an uppermost one of the trays in the plurality of stages located at the outer position, to the inner position and to establish a work sheet placing condition in which the work sheet holding means is positioned above a work sheet placement target tray that is a tray located one stage below the uppermost tray.

The work sheet conveying and housing system according to the present invention performs the following operation. The work sheet conveying device allows the moving means to move the work sheet holding means holding the work sheet to convey the work sheet to the vicinity of the work sheet stocker. The work sheet stocker pre-positions the trays in all the stages at the outer position. Any method may be used to position the trays at the outer position. The moving means moves the work sheet holding means parallel to the tray position switching direction to switch the position of the uppermost tray from the outer position to the inner position. Furthermore, the work sheet placing condition is established in which the work sheet holding means is positioned above the work sheet placement target tray that is the tray located one stage below the uppermost tray. In the work sheet placing condition, the work sheet holding means releases and places the work sheet on the work sheet placement target tray. Then, the work sheet holding means is lowered by one stage in the tray housing portion relative to the work sheet stocker. The moving means then moves the work sheet holding means parallel to the position switching direction. The work sheet holding means then releases the work sheet. This is repeated to place work sheets on the trays in the respective stages and to switch the position of the trays with the work sheets placed thereon to be switched from the outer position to the inner position. For the lowermost tray, it is unnecessary for the work sheet holding means to perform the operation of releasing the work sheet. The work sheet conveying and housing system performs the single operation of moving the work sheet holding means parallel to the tray position switching direction to simultaneously achieve placement of the work sheet on the tray and the switching of the position of the tray with the work sheet placed thereon from the outer position to the inner position. The operation of the work sheet conveying device can thus be simplified, allowing the work sheets to be efficiently housed in the work sheet stocker. The work sheets are housed in the plurality of stages of the shelf in the work sheet stocker without coining into contact with one another. The work sheet in each of the stages can thus be freely taken out. Furthermore, even where the work sheets are formed articles, a large number of work sheets can be housed without being collapsed. Additionally, the formed parts of the formed articles are prevented from being crushed or damaged.

The work sheet conveying device preferably has a elevating and lowering means for elevating and lowering the work sheet holding means so that the work sheet holding means can be positioned at a height corresponding to each of the stages of the tray housing portion in the stocker frame. The provision of the elevating and lowering means enables the work sheet holding means to be positioned at the height corresponding to each of the stages of the tray housing portion in the stocker frame. The work sheet can thus be accurately housed on the tray in each of the stages, and the position of each tray can be accurately switched from the outer position to the inner position.

According to the present invention, the system can be configured such that the work sheet holding means releases the held work sheet in the work sheet placing condition. Where the work sheet holding means releases the held work sheet in the work sheet placing condition, the work sheet holding means need not be operated after the work sheet placing condition has been established. This simplifies the operation of the work sheet holding means, improving the efficiency of work sheet housing.

A work sheet conveying and holding method according to the present invention is applicable to a work sheet conveying and housing system comprising a work sheet stocker in which a plurality of work sheets can be housed, and a work sheet conveying device that conveys a work sheet to the work sheet stocker, the work sheet stocker having a stocker frame having a tray housing portion with a plurality of stages, and trays which are provided in the respective stages of the tray housing portion and the position of which can be freely switched between an inner position where the trays are housed in the tray housing portion and an outer position where the tray are drawn out of the tray housing portion, the work sheet conveying device having a work sheet holding means capable of holding the work sheet, and a moving means having a function of moving the work sheet holding means parallel to a position switching direction corresponding to a direction in which the trays are drawn out. The work sheet conveying and housing method comprises a tray outer-position switching step of positioning the trays in all the stages in the work sheet stocker, at the outer position, a height adjusting step of adjusting one or both of the work sheet holding means and the work sheet stocker so that height of the work sheet holding means corresponds to height of an uppermost one of the trays in the plurality of stages located at the outer position, the work sheet holding means moving step of allowing the horizontal moving means to move the work sheet holding means parallel to the position switching direction to switch a position of the uppermost one of the trays in the plurality of stages located at the outer position, to the inner position and establishing a work sheet placing condition in which the work sheet holding means is positioned above a work sheet placement target tray that is a tray located one stage below the uppermost tray, and a work sheet releasing step of allowing the work sheet holding means to release the held work sheet in the work sheet placing condition. Any method may be used to position the trays at the outer position.

The work sheet conveying and housing method according to the present invention repeats, after the tray outer position switching step, the height adjusting step, the work sheet holding means moving step, and the work sheet releasing step to place the work sheet on the tray in each of the stages, while switching the position of the tray with the work sheet placed thereon from the inner position to the outer position. For the lowermost tray, it is unnecessary for the work sheet holding means to perform the operation of releasing the work sheet. The work sheet conveying and housing method performs the single operation of moving the work sheet holding means parallel to the tray position switching direction to simultaneously achieve placement of the work sheet on the tray and the switching of the position of the tray with the work sheet placed thereon from the outer position to the inner position. The operation of the work sheet conveying device can thus be simplified, allowing the work sheets to be efficiently housed in the work sheet stocker. The work sheets are housed in the plurality of stages of the shelf in the work sheet stocker without coming into contact with one another. The work sheet in each of the stages can thus be freely taken out. Furthermore, even where the work sheets are formed articles, a large number of work sheets can be housed without being collapsed. Additionally, the formed parts of the formed articles are prevented from being crushed or damaged.

The work sheet conveying and housing system according to the present invention comprises the work sheet stocker in which the plurality of work sheets can be housed, and the work sheet conveying device that conveys the work sheet to the work sheet stocker, and the work sheet stocker has the stocker frame having the tray housing portion with the plurality of stages, and the trays which are provided in the respective stages of the tray housing portion and the position of which can be freely switched between the inner position where the trays are housed in the tray housing portion and the outer position where the tray are drawn out of the tray housing portion. The work sheet conveying device has the work sheet holding means capable of holding the work sheet, and the moving means having the function of moving the work sheet holding means parallel to the position switching direction corresponding to the direction in which the trays are drawn out. The moving means moves the work sheet holding means parallel to the position switching direction to switch the position of the uppermost one of the trays in the plurality of stages located at the outer position, to the inner position and to establish the work sheet placing condition in which the work sheet holding means is positioned above the work sheet placement target tray that is the tray located one stage below the uppermost tray. This makes it possible to efficiently convey and house work sheets such as product work sheets which are processed by a work sheet processing machine. Furthermore, in the housed condition, each of the work sheets can be freely taken out. Additionally, where the product work sheets are formed articles, a large number of work sheets can be housed without being collapsed. The formed parts of the formed articles are also prevented from being crushed or damaged.

Where the work sheet conveying device has the elevating and lowering means for elevating and lowering the work sheet holding means so that the work sheet holding means can be positioned at the height corresponding to each of the stages of the tray housing portion in the stocker frame, when work sheets are placed on the trays in the plurality of stages, the work sheets can be accurately housed on the trays in the respective stages. Furthermore, the position of the trays with the work sheets placed thereon can be accurately switched from the outer position to the inner position.

When the system is configured such that the work sheet holding means releases the held work sheet in the work sheet placing condition, the operation of hosing the work sheets can be simplified.

The work sheet conveying and holding method according to the present invention is used for the work sheet conveying and housing system comprising the work sheet stocker in which the plurality of work sheets can be housed, and the work sheet conveying device that conveys the work sheet to the work sheet stocker, the work sheet stocker having the stocker frame having the tray housing portion with the plurality of stages, and the trays which are provided in the respective stages of the tray housing portion and the position of which can be freely switched between the inner position where the trays are housed in the tray housing portion and the outer position where the tray are drawn out of the tray housing portion, the work sheet conveying device having the work sheet holding means capable of holding the work sheet, and the moving means having the function of moving the work sheet holding means parallel to the position switching direction corresponding to the direction in which the trays are drawn out. The work sheet conveying and housing method comprises the tray outer-position switching step of positioning the trays in all the stages in the work sheet stocker, at the outer position, the height adjusting step of adjusting one or both of the work sheet holding means and the work sheet stocker so that the height of the work sheet holding means corresponds to the height of the uppermost one of the trays in the plurality of stages located at the outer position, the work sheet holding means moving step of allowing the moving means to move the work sheet holding means parallel to the position switching direction to switch the position of the uppermost one of the trays in the plurality of stages located at the outer position, to the inner position and establishing the work sheet placing condition in which the work sheet holding means is positioned above the work sheet placement target tray that is the tray located one stage below the uppermost tray, and the work sheet releasing step of allowing the work sheet holding means to release the held work sheet in the work sheet placing condition. This makes it possible to efficiently convey and house work sheets such as product work sheets which are processed by a work sheet processing machine. Furthermore, in the housed condition, each of the work sheets can be freely taken out. Additionally, where the product work sheets are formed articles, a large number of work sheets can be housed without being collapsed. The formed parts of the formed articles are also prevented from being crushed or damaged.

Other features, elements, processes, steps, characteristics and advantages of the present invention will become more apparent from the following detailed description of preferred embodiments of the present invention with reference to the attached drawings.

DETAILED DESCRIPTION OF THE PREFERRED EMBODIMENTS

Figure 1:
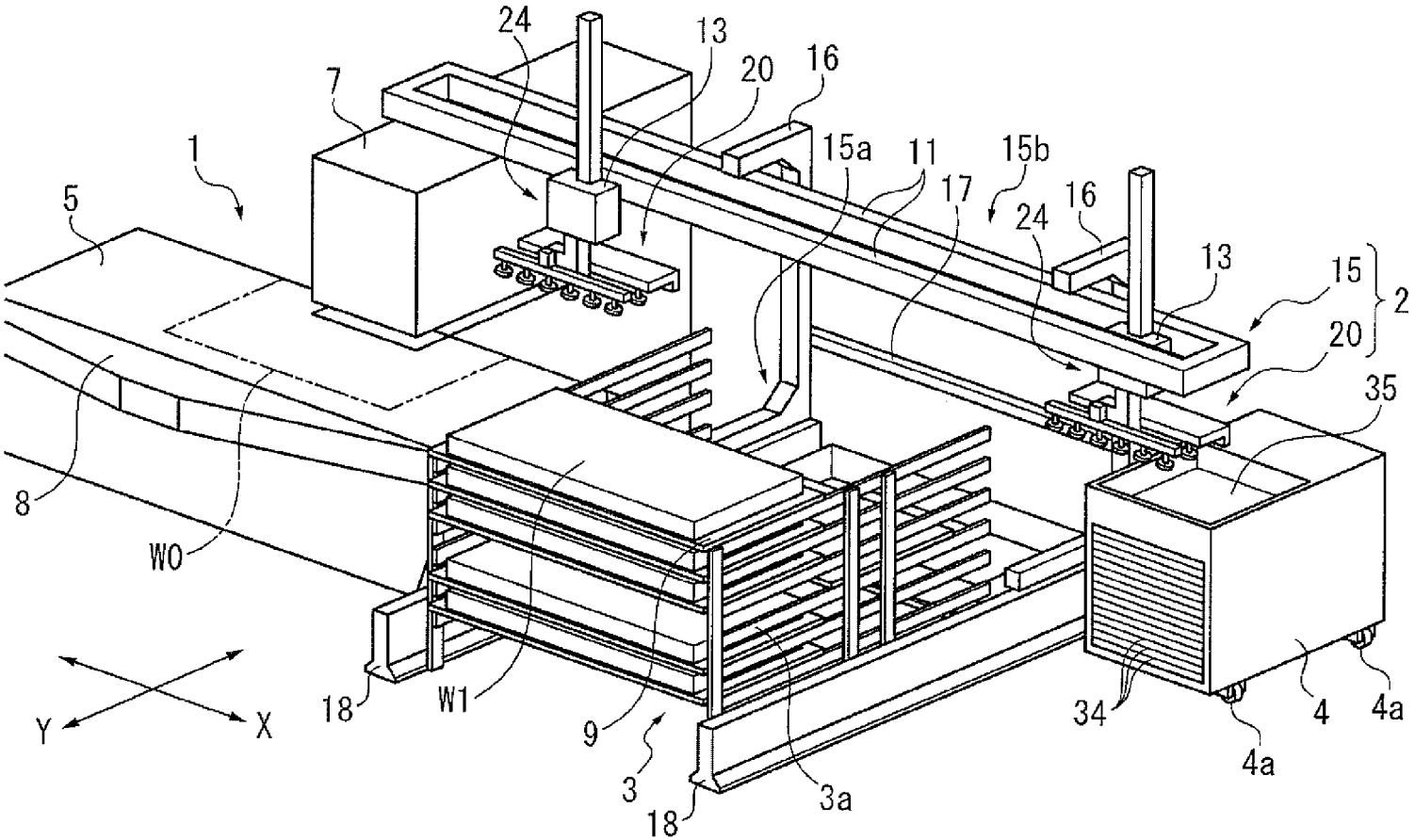
FIG. 1 is a perspective view of a work sheet processing facility comprising a work sheet conveying and housing system according to an embodiment of the present invention.

An embodiment of the present invention will be described with reference to FIG. 1 to FIG. 9. FIG. 1 is a perspective view of a work sheet processing facility comprising a work sheet conveying and housing system according to the embodiment. The work sheet processing facility comprises a work sheet processing machine 1, a work sheet conveying device 2, and work sheet stockers 3, 4 for large-sized work sheets, and medium- and small-sized work sheets, respectively. The work sheet conveying device 2 and the work sheet stocker 4 for medium- and small-sized work sheets constitute the work sheet conveying and housing system. The work sheet processing facility further comprises a work sheet carry-in device (not shown in the drawings) that carries in material work sheets W0 into the work sheet processing machine 1. However, the description of the work sheet carry-in device is omitted.

The work sheet processing machine 1 comprises a function of cutting a plurality of product work sheets from the material work sheet W0 on a table 5 by means of punching or the like. The work sheet processing machine 1 is composed of a punch press, a laser processor, or the like. In this example, the work sheet processing machine 1 is a punch press, and comprises a processing portion 7 that elevates and lowers a punch tool (not shown in the drawings) with respect to a die tool (not shown in the drawings) for processing, and a work sheet feeding mechanism 8 that moves the material work sheet W0 on the table 5 forward and backward (Y direction) and rightward and leftward (X direction).

The work sheet conveying device 2 is a device that conveys product work sheets W1~W3 (see FIGS. 1, 4, 8 and 9) processed by the work sheet processing machine 1 to the work sheet stocker 3 for large-sized work sheets or the work sheet stocker 4 for medium- and small-sized work sheets. The work sheet conveying device 2 is composed of a work sheet holding means 20 capable of holding the product work sheets W1 to W3 and a moving means 15 for moving the work sheet holding means 20 rightward and leftward, and upward and downward. Two tracks 11 and two traveling members 13 are provided as a mechanism 15*b* in the moving means 15 which moves the work sheet holding means 20 rightward and leftward; the tracks 11 are installed parallel to each other between the work sheet processing machine 1 and a position where the work sheet stocker 4 is stopped and face in a lateral direction, and the traveling members 13 are travelable independently along the tracks 11. Each of the traveling members 13 has the work sheet holding means 20 that can be freely elevated and lowered by a elevating and lowering means 24. The elevating and lowering means 24 is a mechanism that moves the work sheet holding means 20 of the moving means 15 upward and downward. The work sheet holding means 20 and the elevating and lowering means 24 will be described below in further detail.

Figure 6:
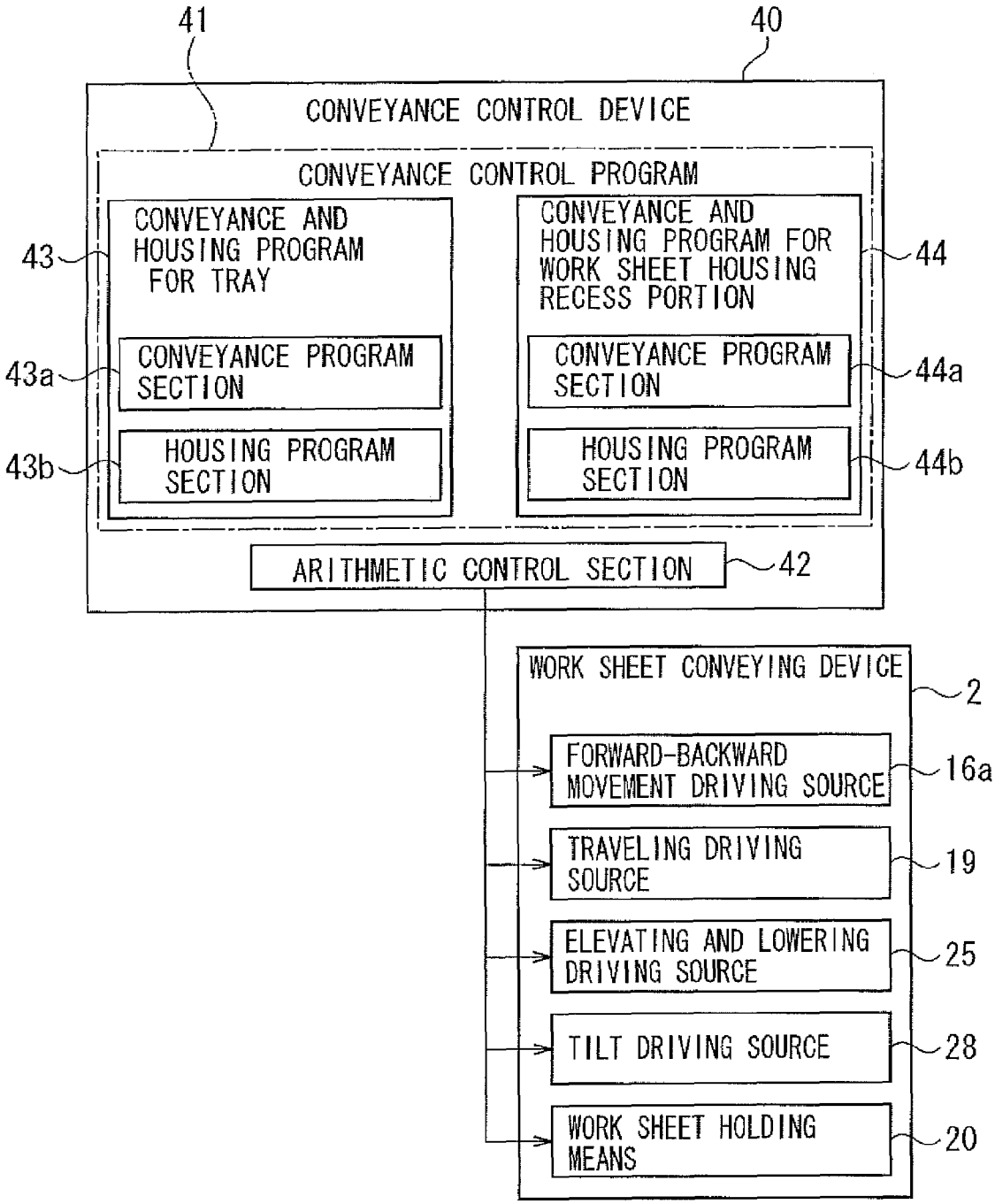
FIG. 6 is a block diagram showing the conceptual configuration of a control system in the work sheet processing facility.

A mechanism 15*a* in the moving means 15 which moves the work sheet holding means 20 forward and backward is configured as follows. That is, the two tracks 11 are integrally coupled together at the opposite ends thereof. The tracks 11, are supported by a lateral pair of forward-backward moving frames 16. The front-back moving frames 16 each have an upper end fixed to the rear track 11 and are coupled together via a horizontal frame 17. The lateral pair of frontward-backward moving frames 16 is movable along forward-backward moving rails 18 and can be moved forward and backward by a forward-backward movement driving source 16*a* (FIG. 6). The forward-backward movement driving source 16*a* is composed of, for example, a servo motor and a transformation mechanism such as a ball screw which transforms rotation of the servo motor into a linear operation. This allows the tracks 11, the traveling members 13, the elevating and lowering means 24, and the work sheet holding means 20 to be integrally moved forward and backward. In the present embodiment, the mechanism 15*a* in the moving means 15 which moves the work sheet holding means 20 forward and backward provides a function of moving the work sheet holding means 20 parallel to a direction in which the position of trays 34 is switched.

Figure 2:
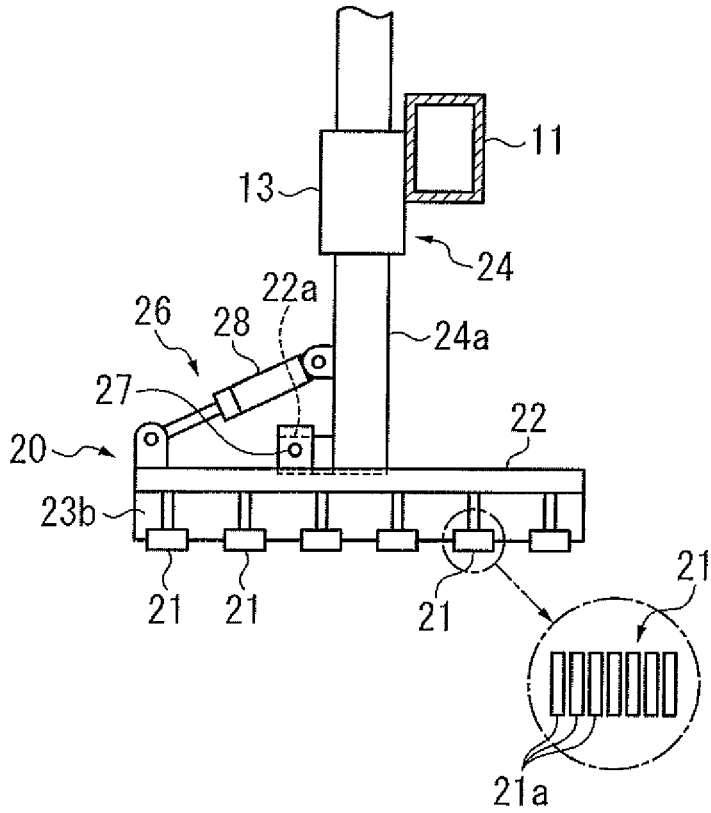
FIG. 2 is a front view of a traveling member and a work sheet holding means of a work sheet conveying device in the work sheet conveying and housing system.
Figure 3:
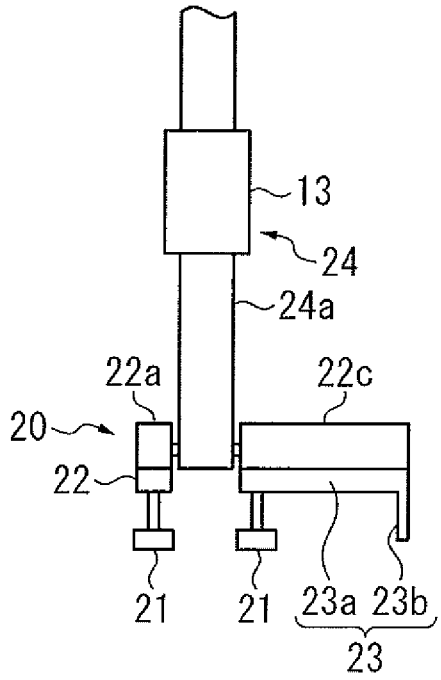
FIG. 3 is a side view of the traveling member and the work sheet holding means.

FIG. 2 and FIG. 3 show the traveling member 13 and the work sheet holding means 20 traveling along the front side track 11. The traveling member 13 traveling along the front side track 11 is slightly partly different from that traveling along the rear side track 11. However, both traveling members 13 have basically the same configuration. Each of the traveling members 13 is provided on the track 11 so as to be travelable via a guide member (not shown in the drawings). The traveling member 13 is self-propelled by a traveling driving source 19 (FIG. 6) such as a servo motor. The guide member is, for example, a linear roller bearing or a guide roller and is interposed between the traveling member 13 and the track 11.

The work sheet holding means 20 has a plurality of suction pads 21. In the present embodiment, six suction pads are provided in each a front row and a rear row; a total of 12 suction pads 21 are provided. As shown in a partly enlarged view in FIG. 2, each of the suction pads 21 is composed of a bundle of a plurality of unit suction pads 21*a* individually connected to a vacuum source via a throttled path. Even where some of the unit suction pads 21*a* are out of contact with a suction target such as any of the product work sheets W1~W3, the suction pad 22 can suck the product work sheets W1~W3. The suction pad 21 as a whole may constitute a single negative pressure portion instead of being formed into a bundle as described above.

The suction pads 21 in the front and rear rows are attached to pad support frames 22, 23. The pad support frame 23 for the rear row also serves as a pusher acting on the tray where the work sheet is loaded in the work sheet stocker 4 as described below. The pad support frame 23 is composed of a plate-like portion 23*a* to which the suction pads 21 are attached at a front end thereof, and a tray pushing portion 23*b* bent from a rear end of the plate-like portion 23*a*. A lower end of the tray pushing portion 23*b* is slightly higher than a lower end of the suction pad 21.

In the present embodiment, the elevating and lowering means 24 of the work sheet holding means 20 has an elevating and lowering member 24*a* extending in the vertical direction and fitted in the traveling member 13 so that the elevating and lowering member 24*a* can be elevated and lowered. The elevating and lowering member 24*a* is elevated and lowered by an elevating and lowering driving source 25 (FIG. 6). The pad support frame 21 of the work sheet holding means 20 is attached to a lower end of the elevating and lowering member 24*a*. The elevating and lowering driving source 25 may be provided separately from the traveling member 13 or the traveling member 13 itself may be the elevating and lowering driving source. The elevating and lowering member 24 of the traveling member 13 traveling along the front track 11 has a rightward bent lower end.

Furthermore, the work sheet holding means 20 can be tilted by a tilting mechanism 26. The tilting mechanism 26 pivotably couples the lower end of the elevating and lowering member 24*a* to projecting pieces 22*a*, 23*a* provided on a top surface of the pad support frame 21, via a pivoting support point shaft 27. The tilting mechanism 26 uses a tilt driving source 28 such as a fluid cylinder to tilt the product holder 20 such that a right side of the works sheet holding means 20 faces downward.

As shown in FIG. 1, the work sheet stocker 3 for large-sized work sheets is a device that places product work sheets W1, that is, large-sized ones of the product work sheets processed by the work sheet processing machine 1, on palettes 9 in a stack. The work sheet stocker 3 has a shelf 3*a* with multiple stages on which the palettes 9 are placed. The palette 9 in any stage of the shelf 3*a* of the work sheet stocker 3 can be moved forward and backward between an illustrated front storage position and a product carry-in position to which the palette 9 is moved from the storage position in the Y direction.

Figure 4:
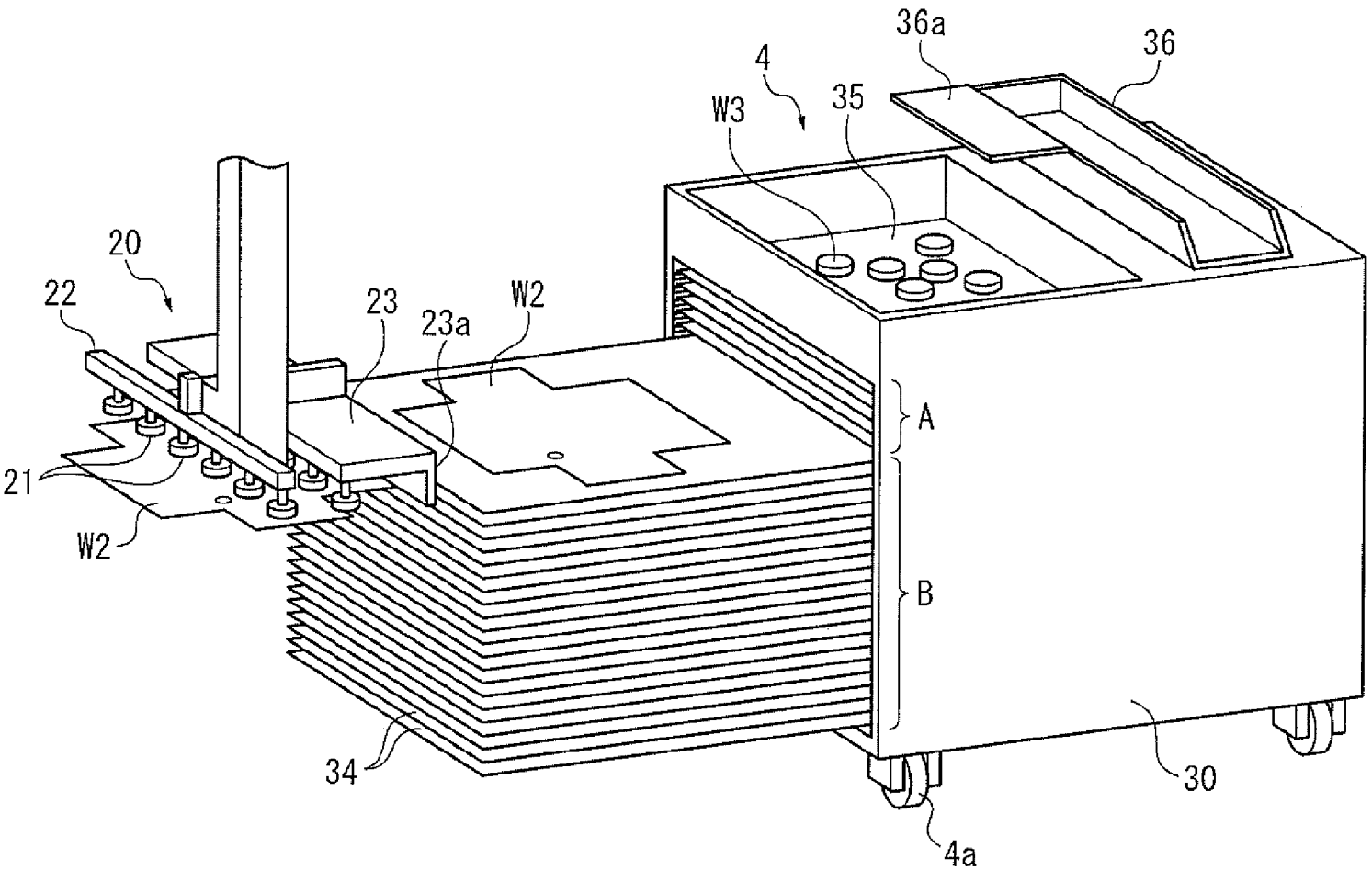
FIG. 4 is a perspective view of a work sheet stocker in the work sheet conveying and housing system.
Figure 5:
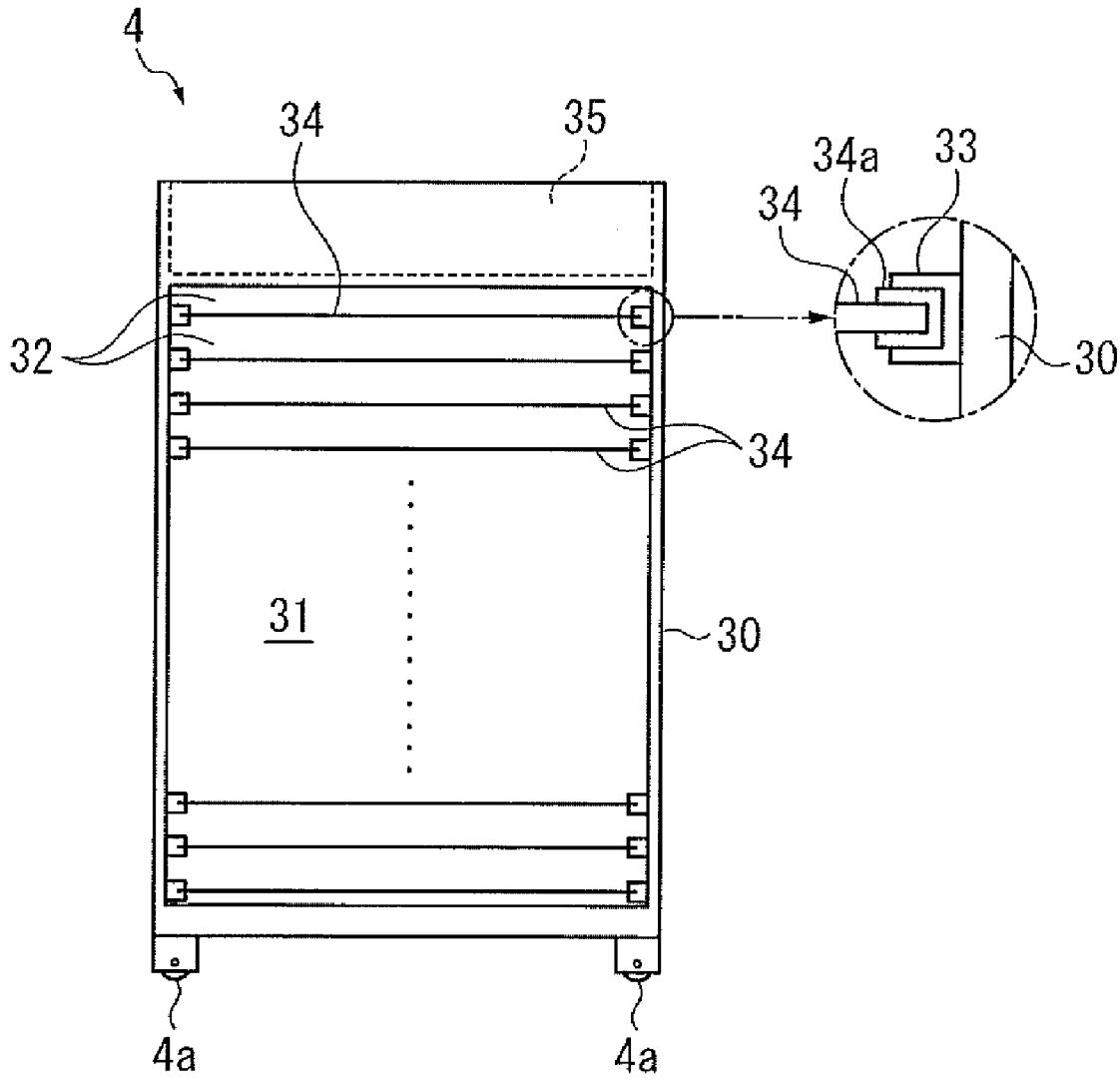
FIG. 5 is a front view of the work sheet stocker.

The work sheet stocker 4 for medium- and small-sized work sheets is a device in which medium-sized ones W2 and small-sized ones W3 of the product work sheets processed by the work sheet processing machine 1 are loaded. The work sheet stocker 4 comprises casters 4*a* and is movable. As shown in FIG. 4 and FIG. 5, a tray housing space 31 is formed, as an opening, in one side surface of a stocker frame 30 shaped like a rectangular parallelepiped. The tray housing space 31 constitutes tray housing portions 32 corresponding to a plurality of stages. A tray 34 slidably supported by guide members 33 made of resin or the like is provided in each of the tray housing portion 32. Specifically, as shown in a partly enlarged view in FIG. 5, sliding members 34*a* attached to the opposite ends of the tray 34 slidably engage the guide members 33. The position of each of the trays 34 can be freely switched between an inner position A where the tray 34 is housed in the tray housing portion 32 and an outer position B where the tray 34 is drawn out from the inner position A. Furthermore, a work sheet housing recess portion 35 that is open upward is formed at the top of the stocker frame 30. For example, the medium-sized product work sheets W2 are placed and housed on the trays 34 in the respective stages, whereas the small-sized product work sheets W3 are housed in the work sheet housing recess portion 35.

A portable tray 36 shown in FIG. 4 is used to house the small-sized product work sheets W3 in the work sheet housing recess portion 35. The portable tray 36 is shaped like a dustpan and a top surface and one side surface thereof are open. An extending portion 36*a* extending outward is formed on a part of a side surface material of the portable tray 36. The work sheet holding means 20 holds the portable tray 36 by using the suction pads 21 of the work sheet holding means 20 to suck the extending portion 36*a*.

A conveyance control device controlling the work sheet conveying device 2 will be described with reference to FIG. 6. The conveyance control device 40 is composed of a computerized numerical control device and a program controller and comprises a conveyance control program 41 and an arithmetic control section 42 that executes the conveyance control program 41. The conveyance control program 41 is composed of a conveyance and housing program for the tray 43, and a conveyance and housing program for the work sheet housing recess portion 44. Moreover, the conveyance and housing program for the tray 43 is divided into a conveyance program portion 43*a* and a housing program portion 43*b*. The conveyance and housing program for the work sheet housing recess portion 44 is also divided into a conveyance program portion 44*a* and a housing program portion 44*b*. The arithmetic control section 42 includes a central processing unit and a memory, as well as a programmable controller.

The arithmetic control section 42 of the conveyance control device 40 issues output instructions to the driving sources for the work sheet carry-put device 2. The driving sources include the forward-backward movement driving source 16*a* for the forward-backward moving frame 16, the traveling driving source 19 for the traveling member 13, the elevating and lowering driving source 25 for the work sheet holding means 20, the tilt driving source 28 for the work sheet holding means 20, and a suction driving source for the work sheet holding means 20.

Figure 7:
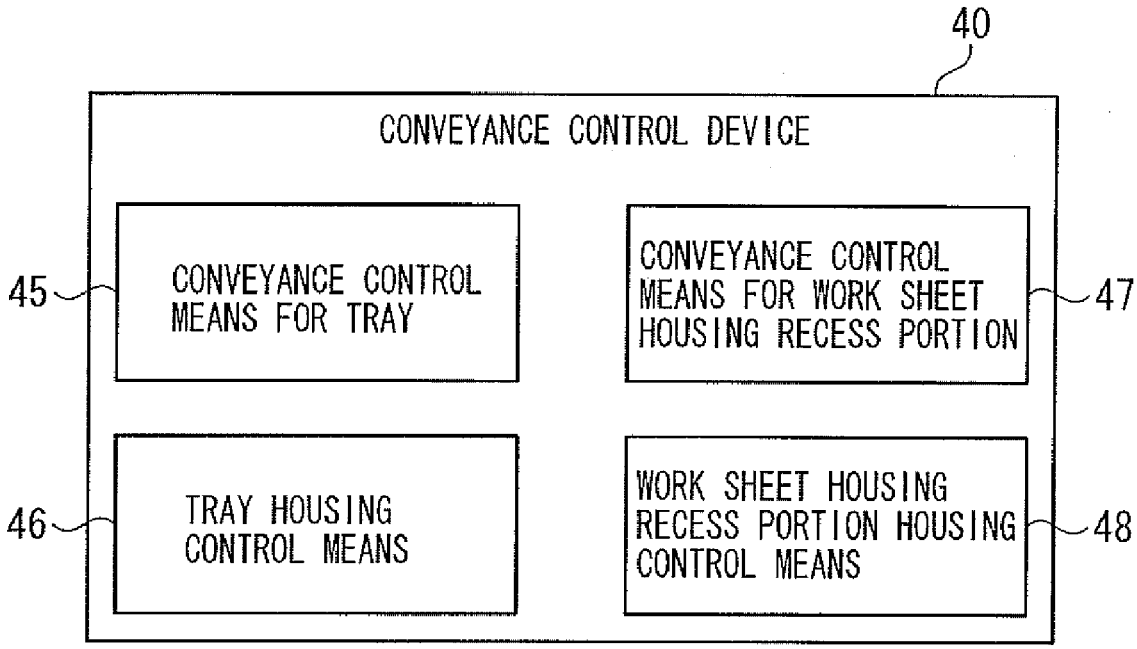
FIG. 7 is a block diagram showing the conceptual configuration of the conveyance control device.

In the conveyance control device 40, the arithmetic control portion 42 and the conveyance control program 41 constitute a function achieving means shown in FIG. 7. That is, the conveyance control device 40 has a conveyance control means for the tray 45, a tray housing control means 46, a conveyance control means for the work sheet housing recess portion 47, and a work sheet housing recess portion housing control means 48. The conveyance control means 45 for the tray performs control such that the medium-sized product work sheets W2 on the work sheet processing machine 1 is conveyed to the work sheet stocker 4. The tray housing control means 46 performs control such that the product work sheets W2 conveyed to the work sheet stocker 4 are placed and housed on the trays 34 in the respective stages in the work sheet stocker 4. The conveyance control means for the work sheet housing recess portion 47 performs control such that a plurality of the small-sized product work sheets W3 on the work sheet processing machine 1 are placed in the portable tray 36 at a time and the portable tray 36 as a whole is then conveyed to the work sheet stocker 4. The work sheet housing recess portion housing control means 48 performs control such that the product work sheets W3 conveyed to the work sheet stocker 4 are housed in the work sheet housing recess portion 35 of the work sheet stocker 4. In addition to the control sections 44~48, the conveyance control device 40 has a palette loading control section that allows the large-sized product work sheets W1 on the work sheet processing machine 1 to be loaded on the palette 9 in the work sheet stocker 3 through the cooperation between the two traveling members 13. However, the description of the palette loading control section is omitted.

A description will be given of an operation performed by the work sheet conveying device 2 under the control of the conveyance control means for the tray 45. The conveyance control means for the tray 45 issues an output instruction to the forward-backward movement driving source 16*a* and the traveling driving source 19 to cause the forward-backward movement driving source 16*a* and the traveling driving source 19 to move the traveling member 13 located at a home position (not shown in the drawings) to a position above the work sheet processing machine 1. The conveyance control means for the tray 45 then issues an output instruction to the elevating and lowering driving source 25 to cause the elevating and Lowering driving source 25 to lower the work sheet holding means 20. The conveyance control means for the tray 45 then issues an output instruction to the work sheet holding means 20 to cause the work sheet holding means 20 to suck and hold the product work sheet W2 using the suction pads 21. The conveyance control means for the tray 45 then issues an output instruction to the elevating and lowering driving source 25 to cause the elevating and lowering driving source 25 to elevate the work sheet holding means 20. The conveyance control means for the tray 45 then issues an output instruction to the forward-backward movement driving source 16*a* and the traveling driving source 19 to cause the forward-backward movement driving source 16*a* and the traveling driving source 19 to move the traveling member 13 to a position above the work sheet stocker 4.

A description will be given of an operation performed by the work sheet conveying device 2 under the control of the tray housing control means 46, with reference to FIG. 8 illustrating the operation. Before the operation is started, the work sheet stocker 4 is stopped such that the position switching direction of the tray 34 faces in the front-back direction (Y direction). In a tray outer position switching step, the trays 34 in all the stages in the work sheet stocker 4 are pre-located at the outer position B (FIG. 8A). The position switching of each tray 34 from the inner position A to the outer position B is, for example, manually performed. In this condition, the tray housing control means 46 issues an output instruction to the elevating and lowering driving source 25 to cause the elevating and lowering driving source 25 to lower the work sheet holding means 20 positioned above the work sheet stocker 4 to a position immediately above the uppermost one 34(1) of the trays 34 in all the stages located at the inner position B. The work sheet holding means 20 then releases the product work sheet 2. The product work sheet W2 is thus placed on the uppermost tray 34(1) (FIG. 8B).

Figure 8A:
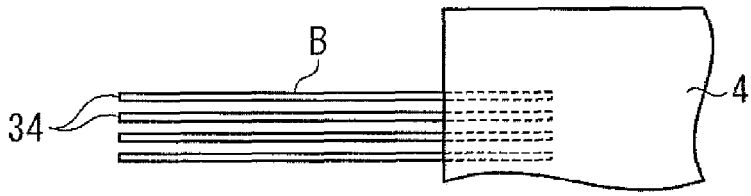
FIG. 8 is a diagram illustrating an operation of housing a work sheet on a tray which operation is performed by the work sheet conveying device.
Figure 8B:
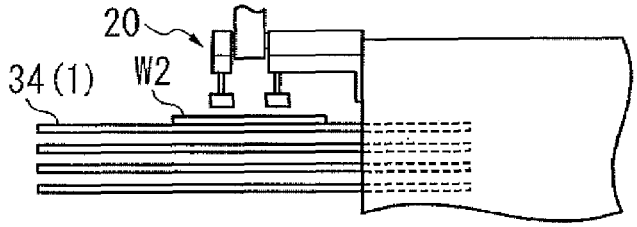
Figure 8C:
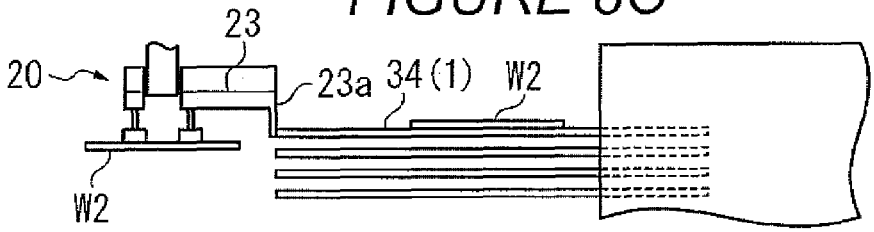
Figure 8D:
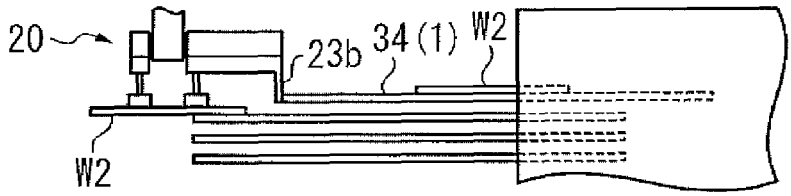

Under the control of the conveyance control means for the tray 45, the work sheet holding means 20 having released the product work sheet W2 returns to the work sheet processing machine 1. The work sheet holding means 20 then holds the next work sheet W2 and moves to above the work sheet stocker 4. In a height adjusting step, the conveyance control means for the tray 45 issues an output instruction to the elevating and lowering driving source 25 to cause the elevating and lowering driving source 25 to lower the work sheet holding means 20 so that the tray pushing portion 23*b* of the pad support frame 23 of the work sheet holding means 20 is located at the same height as that of the uppermost tray 34(1) (FIG. 8C).

Figure 8E:
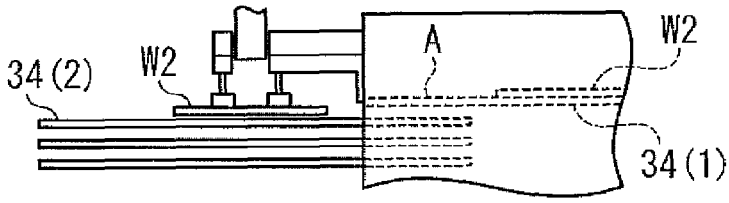

Then, in a work sheet holding means moving step, the conveyance control means for the tray 45 issues an output instruction to the forward-backward movement driving means 16*a* to cause the forward-backward movement driving means 16*a* to move the work sheet holding means 20 backward. The tray pushing portion 23*b* thus pushes the uppermost tray 34(1) (FIG. 8D) to switch the position of the uppermost tray 34(1) from the outer position B to the inner position A (FIG. 8E). Thus, the work sheet holding means 20 is placed at a position immediately above the second tray 34(2) from the top which is the next work sheet placement target tray. A work sheet placing condition is the condition in which the work sheet holding means 20 holding the product work sheet W2 is located at a position immediately above the work sheet placement target tray as described above.

Figure 8F:
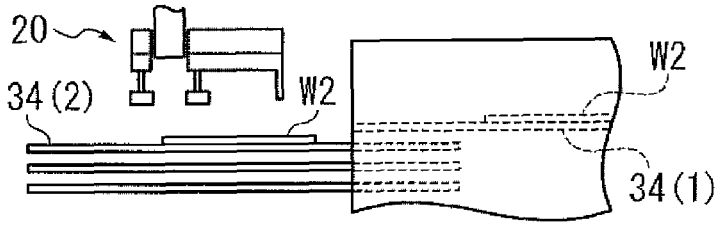

In a work sheet releasing step, the conveyance control means for the tray 45 issues an output instruction to the work sheet holding means 20 in the work sheet placing condition to cause the work sheet holding means 20 to release the held product work sheet W2. The released product work sheet W2 is placed on the second tray 34(2) from the top. The work sheet holding means 30 having released the product work sheet W2 returns to the work sheet processing machine 1 in order to take the next product work sheet W2 (FIG. 8F).

Where the work sheet holding means 20 holding the product work sheet W2 moves to above the work sheet stocker 4 under the control of the conveyance control means for the tray 45, the height adjusting step, the work sheet holding means moving step, and the work sheet releasing step are executed. This is repeated to sequentially place the product work sheets W2 on the trays 34 in the respective stages from top to bottom and to switch the position of the trays 34 with the product work sheets W2 placed thereon from the outer position B to the inner position A. For the lowermost tray 34, it is unnecessary for the work sheet holding means 20 to perform the operation of releasing the product work sheet W2. After the tray pushing portion 23*b* of the pad support frame 23 switches the position of the upper tray 34, the product work sheet W2 is placed on the lower tray 34 with the position thereof remaining unchanged. Thus, the product work sheet W2 is placed on the tray 34 in each stage at the same position.

A description will be given of an operation performed by the work sheet conveying device 2 under the control of the conveyance control means for the work sheet housing recess portion 47. As shown in FIG. 4, it is assumed that in the initial condition, the portable tray 36 is placed on the work sheet stocker 4. First, the conveyance control means for the work sheet housing recess portion 47 issues an output instruction to the forward-backward movement driving source 16*a* and the traveling driving source 19 to cause the forward-backward movement driving source 16*a* and the traveling driving source 19 to move the traveling member 13 located at the home position (not shown in the drawings) to a position above the work sheet stocker 4. The conveyance control means for the work sheet housing recess portion 47 then issues an output instruction to the elevating and lowering driving source 25 to cause the elevating and lowering driving source 25 to lower the work sheet holding means 20. The conveyance control means for the work sheet housing recess portion 47 then issues an output instruction to the work sheet holding means 20 to cause the work sheet holding means 20 to suck and hold the portable tray 36 using the suction pads 22. The conveyance control means for the work sheet housing recess portion 47 then issues an output instruction to each of the forward-backward movement driving source 16*a*, the traveling driving source 19, and the elevating and lowering driving source 25 to cause the forward-backward movement driving source 16*a*, the traveling driving source 19, and the elevating and lowering driving source 25 to move the portable tray 36 to a position on the table 5 of the work sheet processing machine 1 which is close to the processing portion 7.

Then, the work sheet holding means 20 having moved the portable tray 36 or another work sheet holding means 20 places the plurality of product work sheets W3 in the portable tray 36. To place the product work sheets W3 in the portable tray 36, the conveyance control means for the work sheet housing recess portion 47 issues an output instruction to each of the forward-backward movement driving source 16*a*, the traveling driving source 19, and the elevating and lowering driving source 25 to cause the forward-backward movement driving source 16*a*, the traveling driving source 19, and the elevating and lowering driving source 25 to move the work sheet holding means 20 to above the work sheet processing machine 1, lower the work sheet holding means 20 to a surface of the table 5, allow the work sheet holding means to suck an hold the product work sheets W3, elevate and move the work holding means 20 to above the portable tray 36, lower the work sheet holding means 20, and then allows the work sheet holding means 20 to release the product work sheets W3. Thus, the product work sheets W3 processed by the processing portion 7 are housed in the portable tray 36. The series of operations described above are repeated a predetermined number of times. To hold the small-sized product work sheets W3, it is preferable to use the suction pad 21 located at the left end of the front row. This is because the use of the suction pad 21 located at this position makes it possible to easily prevent the work sheet holding means 20 from interfering with the work sheet processing machine 1.

Once a predetermined number of product work sheets W3 are placed in the portable tray 36, the conveyance control means for the work sheet housing recess portion 47 issues an output instruction to the elevating and lowering driving source 25 to cause the elevating and lowering driving source 25 to elevate the work sheet holding means 20 holding the portable tray 36. The conveyance control means for the work sheet housing recess portion 47 then issues an output instruction to the frontward-backward movement driving source 16*a* and the traveling driving source 19 to cause the frontward-backward movement driving source 16*a* and the traveling driving source 19 to move the portable tray 36 to above the work sheet stocker 4.

Figure 9A:
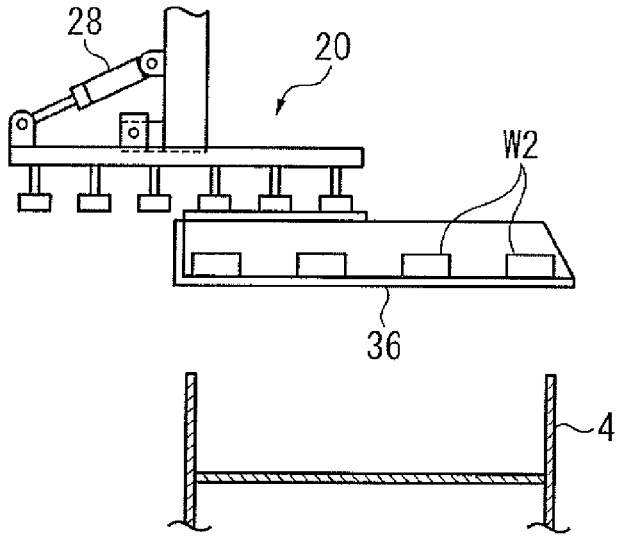
FIG. 9 is a diagram showing an operation of housing work sheets in a work sheet housing recess portion which operation is performed by the work sheet conveying device.
Figure 9B:
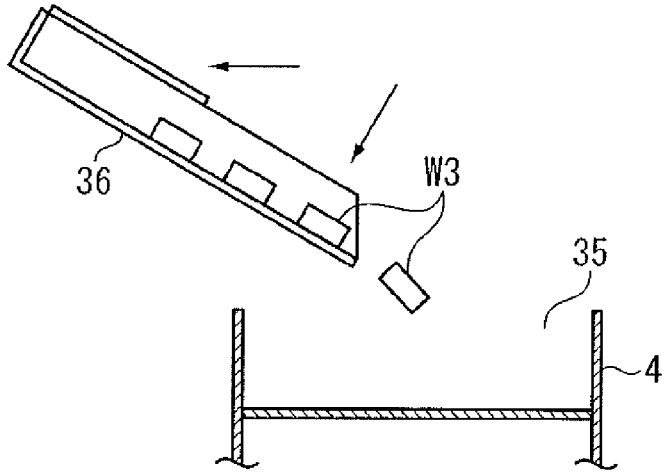
Figure 9C:
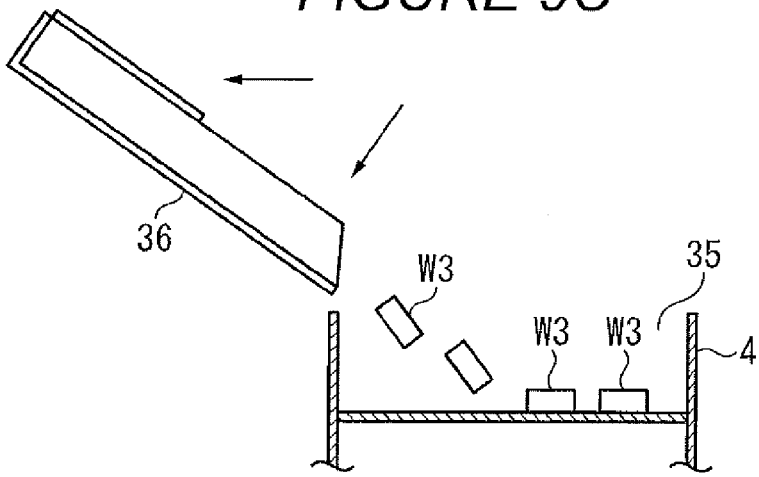

A description will be given of an operation performed by the work sheet conveying device 2 under the control of the work sheet housing recess portion housing control means 48, with reference to FIG. 9 illustrating the operation. The work sheet housing recess portion housing control means 48 issues an output instruction to the elevating and lowering driving source 25 to cause the elevating and lowering driving source 25 to lower the work sheet holding means 20 holding the portable tray 36, from a position above the work sheet stocker 4 to a height slightly above an upper end of the work sheet stocker 4 (FIG. 9A). The work sheet housing recess portion housing control means 48 issues an output instruction to the traveling driving source 19 and the tilt driving source 28 to cause the traveling driving source 19 and the tilt driving source 28 to tilt the portable tray 36 such that an open side surface is located lower, while moving the work sheet holding means 20 rightward (FIG. 9B and FIG. 9C). Then, the product work sheets W3 in the portable tray 36 slip down into the work sheet housing recess portion 35 of the work sheet stocker 4. Thus, tilting the portable tray 36 while moving the work sheet holding means 20 allows the product work sheets W2 to be evenly distributively housed in the work sheet housing recess portion 35. Furthermore, the speed at which the product work sheets W3 slip down from the portable tray 36 can be reduced, reducing a possible impact on the product work sheets W3 to prevent the product work sheets W3 from being damaged. Moreover, where the product work sheets W3 slip down at the reduced speed, the product work sheets W3 can be reliably dropped even into the work sheet housing recess portion 35 with the relatively narrow opening.

The work sheet stocker 4 in the work sheet conveying and housing system has the trays 34, on which the medium-sized ones W2 of the product work sheets processed by the work sheet processing machine 1, are housed and the work sheet housing recess portion 35, in which the small-sized product work sheets W3 are housed. Thus, various types of product work sheets can be sorted and housed. The product work sheets W2 are housed on the trays 34 in the plurality of stages without coming into contact with one another. The product work sheet W2 in each of the stages can thus be freely taken out. Furthermore, since the product work sheets W2 are individually housed, even where the product work sheets W2 are formed articles, the stack of the product work sheets W2 is prevented from being collapsed. Furthermore, the formed parts are prevented from being crushed or damaged. Additionally, since the work sheet housing recess portion 35 is recessed, the small product work sheets W3 can be housed without being distributed.

When the product plate materials W2 are placed and housed on the trays 34, the single operation of moving the work sheet holding means 20 parallel to the position switching direction of the tray 34 simultaneously achieves the switching of the position of the upper tray 34 with the product work sheet W2 placed thereon from the outer position B to the inner position A and the establishment of the work sheet placing condition in which the work sheet holding means 20 is positioned above the lower tray 34 on which the next product work sheet W2 is to be placed. The operation of the work sheet conveying device 2 is thus simplified, allowing the product work sheets W2 to be efficiently housed on the trays 34 in the respective stages. The elevating and lowering means 24 can elevate and lower the work sheet holding means 20 so that the work sheet holding means 20 can be positioned at a height corresponding to the tray housing portion 32 in each stage in the stocker frame 30. This makes it possible to accurately achieve the switching of the position of the tray 34 and the establishment of the work sheet placing condition. Furthermore, the system is configured such that the work sheet holding means 20 releases the product work sheets W2 in the work sheet placing condition. This eliminates the need to operate the work sheet holding means 20 after the work sheet placing condition has been established. The operation of the work sheet holding means 20 can thus be simplified, improving the efficiency with which the work sheets are housed.

Figure 10:
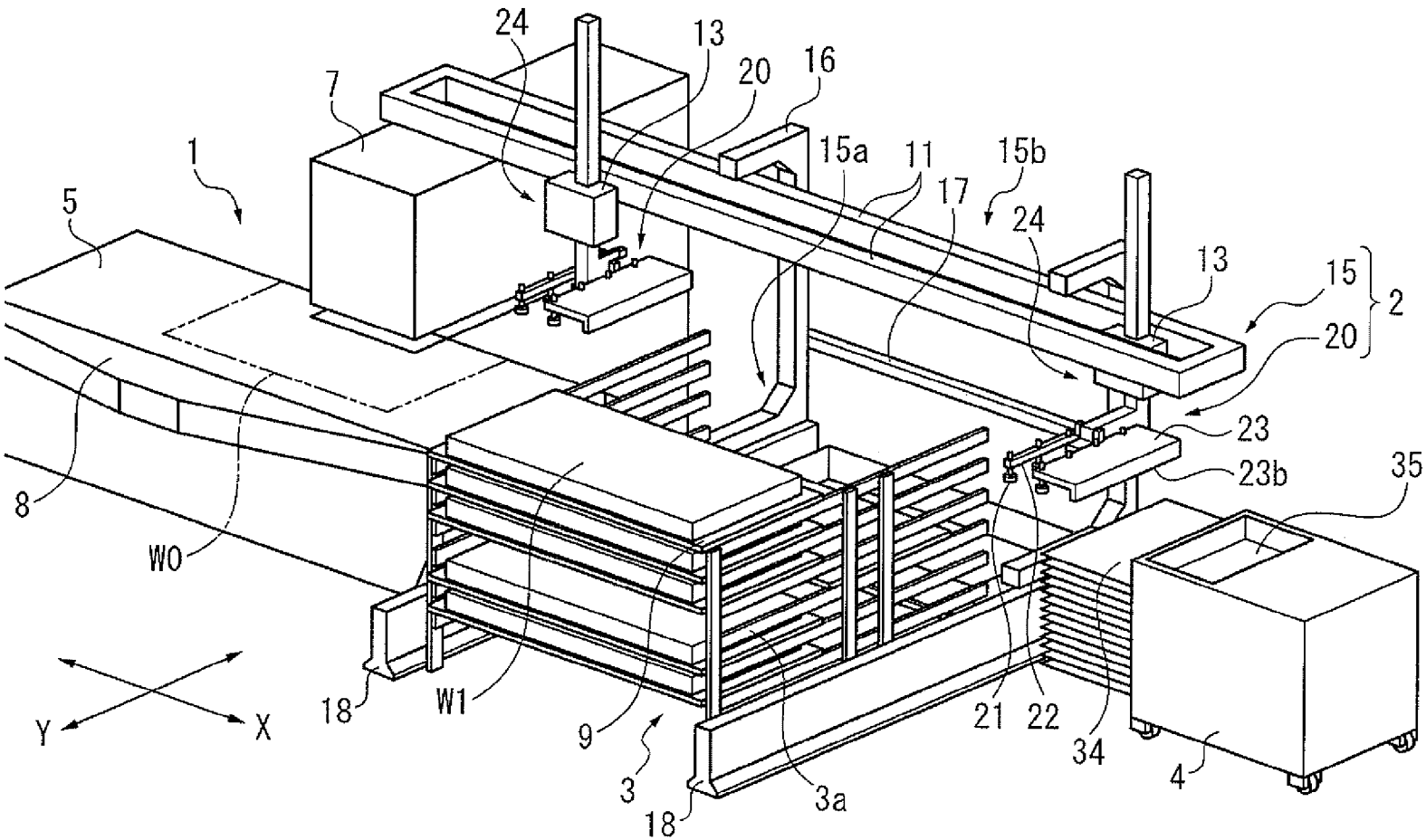
FIG. 10 is a perspective view of a work sheet processing facility comprising a work sheet conveying and housing system according to another embodiment of the present invention.

FIG. 10 shows a different embodiment of the present invention. A work sheet conveying and housing system according to the present embodiment allows the work sheet holding means 20 to move in a lateral direction (X direction) to switch the position of each of the trays 34 in the work sheet stocker 4. Thus, in the present embodiment, the work sheet holding means 20 is located in a phase different from that in the above-described embodiment by 90 degrees. That is, a total of 12 suction pads 21 are provided such that six suction pads 21 are provided on each of the left and right pad support frames 22, 23. The tray pushing portion 23*b* is formed on the right pad support frame 23. Except for the above-described feature, both the work sheet conveying device 2 and the work sheet stocker 4 have the same configuration as that in the above-described embodiment. However, in the above-described embodiment, the function of moving the work sheet holding means 20 parallel to the position switching direction of the tray 34 is provided by the mechanism 15*a* in the moving means 15, which moves the work sheet holding means 20 forward and backward, whereas in the present embodiment, this function is provided by the mechanism 15*b* in the moving means 15, which moves the work sheet holding means 20 rightward and leftward.

In the present embodiment, the work sheet stocker 4 is stopped such that the position switching direction of the trays 34 faces in the lateral direction. To house the medium-sized product work sheet W2 on the tray 34, a work sheet holding means moving step is executed to issue an output instruction to the traveling driving portion 19 to cause the traveling driving portion 19 to move the work sheet holding means 20 rightward so that the tray pushing portion 23*b* pushes the uppermost tray 34 (see FIG. 8D), the position of which is thus switched from the outer position B to the inner position A. Furthermore, the work sheet holding means 20 is positioned immediately above the second tray 34 from the top which is the next work sheet placement target tray, to establish the work sheet placing condition (see FIG. 8E). Moreover, to house the small-sized product work sheets W3 in the work sheet housing recess portion 35, an output instruction is issued to the forward-backward movement driving source 16*a* and the tilt driving source 28 to cause the forward-backward movement driving source 16*a* and the tilt driving source 28 to tilt the portable tray 36 such that the open side surface is located lower, while moving the work sheet holding means 20 backward (FIG. 9B and FIG. 9C). The present embodiment provides operations and effects similar to those of the above-described embodiment.

In the above-described embodiments, since the vertical interval between the trays 34 is small and there is only a small difference between the product work sheet W2 held by the work sheet holding means 20 in the work sheet placing condition and the work sheet placement target tray 34, located under the product work sheet W2, the work sheet holding means 20 releases the product W2 in the work sheet placing condition. However, where the vertical interval between the trays 34 is larger, the work sheet holding member 20 is lowered from the position corresponding to the work sheet placing condition before releasing the product work sheet W2.

Furthermore, in each of the above-described embodiments, in the tray outer position switching step, the switching of the position of each tray 34 from the inner position A to the outer position B is manually performed. However, this operation may be performed by the work sheet conveying device 2. Moreover, in each of the above-described embodiments, the system has the two traveling members 13. However, the number of traveling members 13 may be only one or at least three. Moreover, in each of the above-described embodiments, the moving means 15 of the work sheet conveying device 2 is composed of the combination of the mechanism 15*a*, which moves the work sheet holding means 20 forward and backward, the mechanism 15*b*, which moves the work sheet holding means 20 rightward and leftward, and the mechanism 24, which moves the work sheet holding means 20 upward and downward. However, the moving means 15 may adopt another configuration, for example, a configuration like an articulated robot.

While the present invention has been described with respect to preferred embodiments thereof, it will be apparent to those skilled in the art that the disclosed invention may be modified in numerous ways and may assume many embodiments other than those specifically set out and described above. Accordingly, it is intented by the appended claims to cover all modifications of the present invention that fall within the true spirit and scope of the invention.

The invention claimed is:

1. A work sheet conveying and housing system comprising:

a work sheet stocker in which a plurality of work sheets can be housed; and a work sheet conveying device that conveys a work sheet to said work sheet stocker, wherein said work sheet stocker has:

a stocker frame having a tray housing portion with a plurality of stages; and trays which are provided on the respective stages of a tray housing portion and a position of which can be freely switched between an inner position where said trays are housed in said tray housing portion and an outer position where said tray are drawn out of said tray housing portion, and wherein said work sheet conveying device has:

a means for holding the work sheet; and a means for moving said means for holding the work sheet parallel to a position switching direction corresponding to a direction in which said trays are drawn out, said means for moving said means for holding the work sheet parallel to said position switching direction to switch a position of an uppermost one of said trays in the plurality of stages located at said outer position, to said inner position simultaneously with establishing a work sheet placing condition in which said means for holding the work sheet is positioned above a work sheet placement target tray that is a tray located one stage below said uppermost tray.

2. A work sheet conveying and housing system according to claim 1, wherein said work sheet conveying device has a means for elevating and lowering said means for holding the work sheet so that said means for holding the work sheet can be positioned at a height corresponding to each of the stages of said tray housing portion in the stocker frame.

3. A work sheet conveying and housing system according to claim 1, wherein said means for holding the work sheet releases the held work sheet in said work sheet placing condition.

4. A work sheet conveying and holding method for a work sheet conveying and housing system comprising: a work sheet stocker in which a plurality of work sheets can be housed; and a work sheet conveying device that conveys a work sheet to said work sheet stocker, said work sheet stocker having: a stocker frame having a tray housing portion with a plurality of stages; and trays which are provided on the respective stages of said tray housing portion and a position of which can be freely switched between an inner position where said trays are housed in said tray housing portion and an outer position where said tray are drawn out of said tray housing portion, said work sheet conveying and holding method comprising the steps of:

holding the work sheet by a sheet holder;

moving said work sheet holder parallel to a position switching direction corresponding to a direction in which said trays are drawn out;

positioning said trays in all the stages in said work sheet stocker, at said outer position;

adjusting a height of one or both of said work sheet holders and said work sheet stocker so that the height of said work sheet holder corresponds to a height of an uppermost one of the trays in the plurality of stages located at said outer position;

simultaneously moving said work sheet holder parallel to said position switching direction to switch a position of the uppermost one of said trays in the plurality of stages located at said outer position, to said inner position and establishing a work sheet placing condition in which said work sheet holding means is positioned above a work sheet placement target tray that is a tray located one stage below said uppermost tray; and releasing the work sheet by said work sheet holder to release the held work sheet in said work sheet placing condition.

* * * * *